US011702257B2

(12) United States Patent
Burek et al.

(10) Patent No.: US 11,702,257 B2
(45) Date of Patent: Jul. 18, 2023

(54) CHILD-RESISTANT STORAGE CASE

(71) Applicant: Edibles Engineering LLC, Tulsa, OK (US)

(72) Inventors: Paul Phillip Burek, Centennial, CO (US); William Edward Ludlow, Tulsa, OK (US)

(73) Assignee: CRATIV Solutions, Inc., Denver, CO (US)

( * ) Notice: Subject to any disclaimer, the term of this patent is extended or adjusted under 35 U.S.C. 154(b) by 208 days.

(21) Appl. No.: 15/295,017

(22) Filed: Oct. 17, 2016

(65) Prior Publication Data

US 2017/0137184 A1 May 18, 2017

Related U.S. Application Data

(60) Provisional application No. 62/255,222, filed on Nov. 13, 2015.

(51) Int. Cl.

| | |
|---|---|
| ***B65D 50/04*** | (2006.01) |
| ***B65D 43/16*** | (2006.01) |
| ***B65D 43/22*** | (2006.01) |

(52) U.S. Cl.

CPC ..... *B65D 50/04* (2013.01); *B65D 43/16* (2013.01); *B65D 43/162* (2013.01); *B65D 43/22* (2013.01); *B65D 50/046* (2013.01)

(58) Field of Classification Search

CPC ..... B65D 50/04; B65D 2543/0907; B65D 2543/00888; B65D 2543/00842; B65D 2543/00833; B65D 2543/00907; B65D 2215/04; B65D 50/0566; B65D 50/066

USPC ..... 220/835; 215/225, 272, 301, 305

See application file for complete search history.

(56) References Cited

U.S. PATENT DOCUMENTS

| | | | | |
|---|---|---|---|---|
| 3,749,230 | A | 7/1973 | Foster | |
| 3,790,429 | A * | 2/1974 | Berger | B43M 7/004 156/703 |
| 3,863,795 | A * | 2/1975 | Mills | B65D 50/045 206/540 |
| 3,907,103 | A | 9/1975 | Shaw | |
| 4,043,448 | A | 8/1977 | Tanaka | |
| 4,048,050 | A | 9/1977 | Hillman | |
| 4,364,488 | A | 12/1982 | Anjou | |
| 4,730,731 | A | 3/1988 | Allison | |

(Continued)

OTHER PUBLICATIONS

Cabela's, "Fly Fishing" catalog, pp. 1 and 76-79, Mar. 2016, Sidney, NE.

(Continued)

*Primary Examiner* — Allan D Stevens

(74) *Attorney, Agent, or Firm* — Cochran Freund & Young, LLC

(57) ABSTRACT

A child-resistant storage case has a lid hinged to a base to define an interior storage space. Two side latches are spaced apart from one another on opposing side aspects of the storage case. A front latch mechanism includes a horizontal tab extending forward from the front aspect of the case. To open the storage case, the user must simultaneously press inward on the side latches, press downward on the horizontal tab, and lift the lid upward. The required downward actuation of the front latch mechanism is counter-intuitive for most people, and in combination with the side latches, is very difficult for most small children.

4 Claims, 6 Drawing Sheets

(56) References Cited

U.S. PATENT DOCUMENTS

| | | | | |
|---|---|---|---|---|
| 4,890,742 | A | 1/1990 | Allison | |
| 5,080,222 | A | 1/1992 | McNary | |
| 5,100,015 | A | 3/1992 | Vanderstuyf | |
| 5,427,265 | A | 6/1995 | Cautereels | |
| 5,722,568 | A * | 3/1998 | Smith | B65D 83/40 220/281 |
| 5,740,938 | A | 4/1998 | Hofmann et al. | |
| 6,021,901 | A | 2/2000 | Wolfe | |
| 6,832,686 | B2 | 12/2004 | Donegan | |
| 7,172,093 | B2 * | 2/2007 | Bando | B65D 83/0805 206/494 |
| 7,549,541 | B2 | 6/2009 | Brozell et al. | |
| 7,757,843 | B2 | 7/2010 | Katsis | |
| 8,220,636 | B2 * | 7/2012 | Beecroft | B65D 83/0472 206/1.5 |
| 8,245,867 | B2 * | 8/2012 | Allen | B65D 43/0212 215/215 |
| 8,875,877 | B2 | 11/2014 | Cottle et al. | |
| 2002/0185404 | A1 * | 12/2002 | Donegan | B65D 77/02 206/531 |
| 2007/0144996 | A1 * | 6/2007 | Sawyer | B65D 47/0809 215/235 |
| 2007/0163911 | A1 * | 7/2007 | Gelardi | B65D 43/16 206/473 |
| 2009/0255842 | A1 | 10/2009 | Brozell et al. | |

OTHER PUBLICATIONS

Photo of a prior art fishing tackle case purchased from Bass Pro Shop (2016).

PCT Search Report and Written Opinion for PCT/US2016/058844, dated Jan. 3, 2017, 6 pages.

* cited by examiner

CHILD-RESISTANT STORAGE CASE

RELATED APPLICATION

The present application is based on and claims priority to the Applicant's U.S. Provisional Patent Application 62/255,222, entitled "Child-Resistant Storage Case," filed on Nov. 13, 2015.

BACKGROUND OF THE INVENTION

Field of the Invention

The present invention relates generally to the field of child-resistant storage cases for medications, valuables and the like. More specifically, the present invention discloses a child-resistant storage case having opposing side latches that must be simultaneously pressed to open the storage case, as well as a front latch that must be pressed downward at the same time.

Background of the Invention

A wide variety of storage boxes and cases have been used since time immemorial. These typically include a bottom and a plurality of side walls defining an interior volume with an upper opening for storing items. A lid can be used to enclose the interior region by sealing the upper opening. The lid is often hinged to one of the side walls. A wide variety of latch mechanisms can be used to secure the lid to the other side walls in the closed position.

Many storage cases are used for storing pills or medications or the like that might be hazardous to small children or pets. These storage cases do not usually require strong security, in sense of a safe or lock box, but rather only need to incorporate features rendering it difficult for a child to open the storage case. This is often referred to as being "child-resistant." Here again, the prior art in this field includes numerous examples of pill bottles, medication containers and other storage cases that incorporate a wide variety of child-resistant features. Many child-resistant features are based on the smaller size of a child's hand, or a child's relative lack of dexterity.

For example, the prior art includes several examples of storage cases having opposing side latches that must be actuated simultaneously to open the storage case. The distance between these side latches is selected to be greater than the span of a small child's hand, but the latches are conveniently spaced for an adult's hand. Similarly, the prior art also includes storage cases having a plurality of latch mechanisms on the sides, front or other aspects of the storage case that must be actuated simultaneously to open the case. Here again, the spacing between the latch mechanisms makes it difficult for a small child to open the case.

SUMMARY OF THE INVENTION

This invention provides child-resistant storage case having opposing side latches that must be simultaneously pressed to open the storage case, as well as a front latch on the lid that must be pressed downward at the same time. The required downward actuation of the front latch is counter-intuitive for most people, and in combination with the side latches, is very difficult for most small children. The storage case can also include a lip or rail covering the seam between the lid and the body of the storage case to prevent the storage case from being pried open with a finger nail or bladed device.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
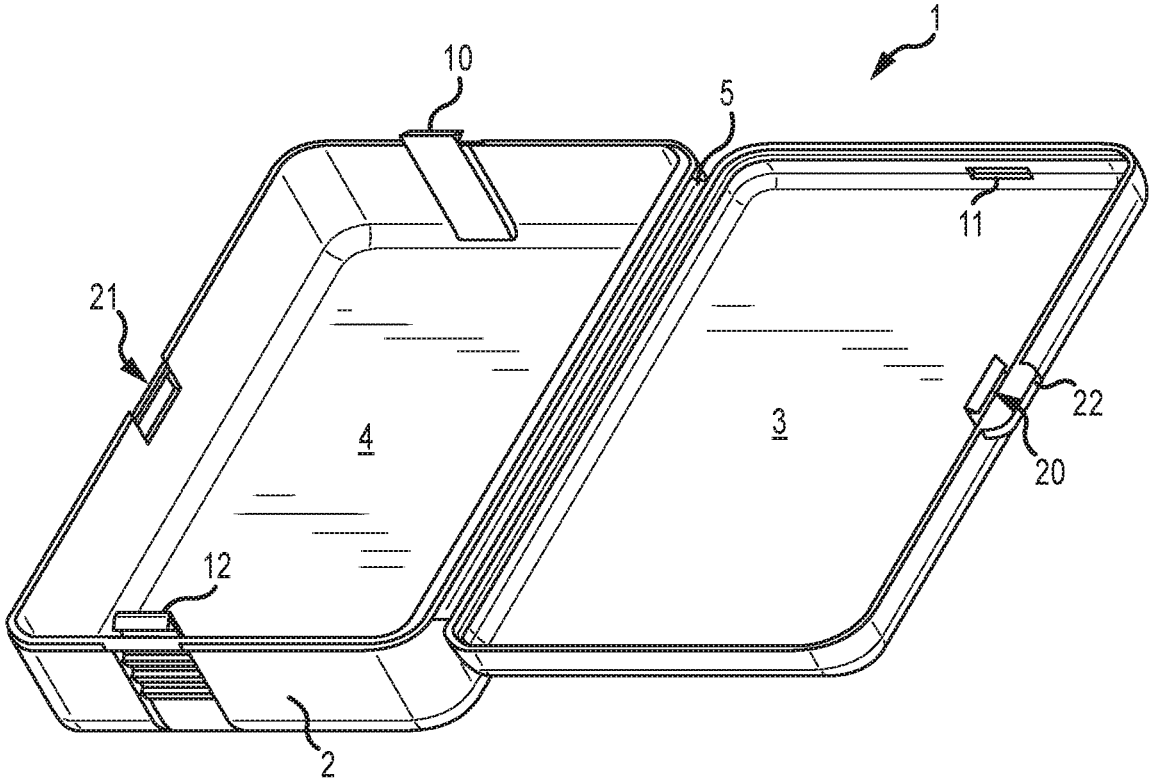
FIG. 1 is an axonometric view of an embodiment of the present storage case 1 with the lid 3 open.
Figure 2:
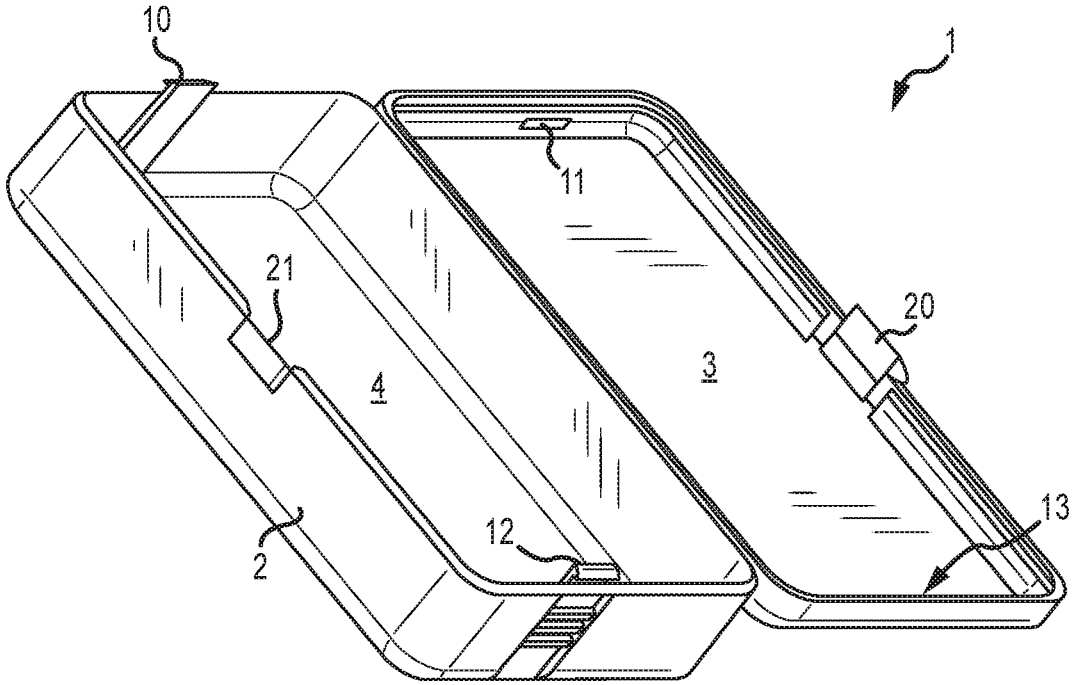
FIG. 2 is another axonometric view corresponding to FIG. 1.
Figures 3, 4, 5, 6:
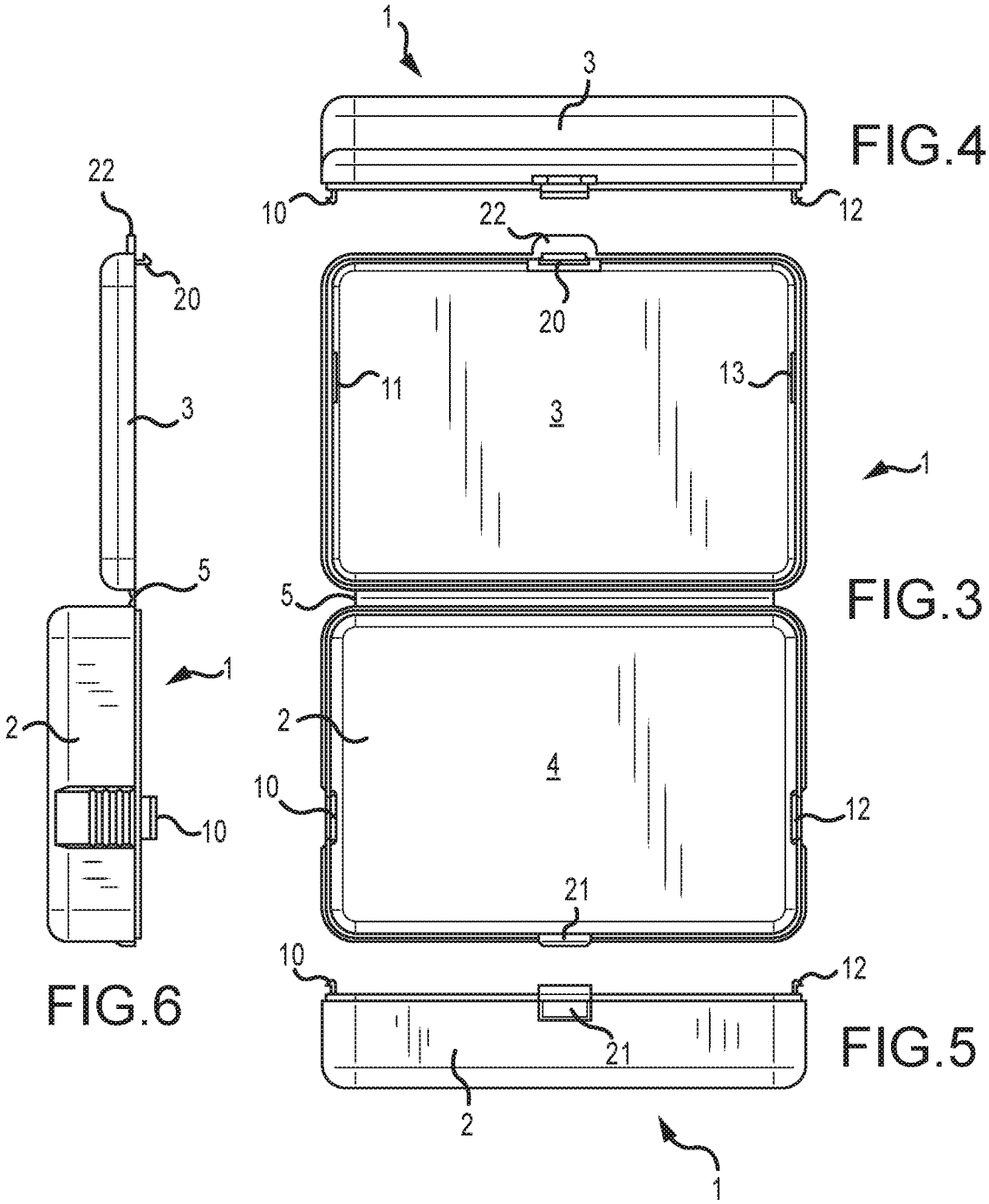
FIG. 3 is a top view corresponding to FIG. 1.
FIG. 4 is a rear view corresponding to FIG. 1.
FIG. 5 is a front view corresponding to FIG. 1.
FIG. 6 is a left side view corresponding to FIG. 1.
Figure 7:
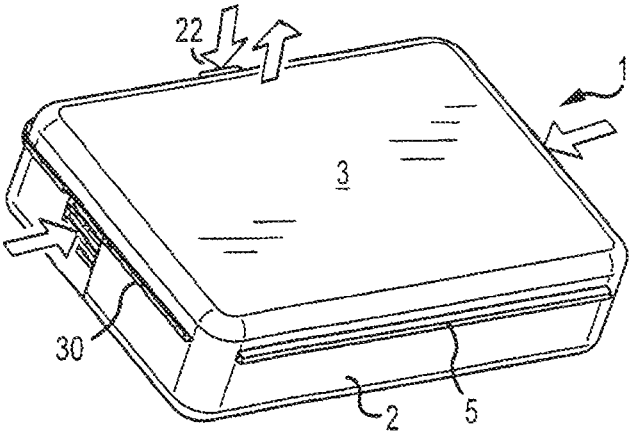
FIG. 7 is an axonometric view of another embodiment of the storage case 1 with the lid 3 closed.
Figure 8:
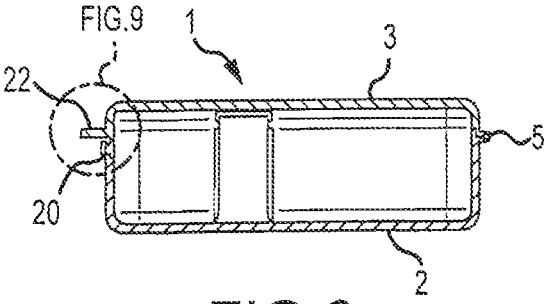
FIG. 8 is a cross-sectional view of the storage case 1 with the lid 3 closed.

FIGS. 1 and 2 provide two axonometric views of an embodiment of the present storage case 1. Corresponding orthogonal views of the storage case 1 with the lid 3 open are shown in FIGS. 3-6. The storage case 1 has a generally rectangular configuration in the embodiment shown in these drawings. It includes a base 2 with front, rear and opposing side walls defining an interior storage space 4 within the peripheral walls of the storage case 1. A lid 3 is connected by a hinge 5 to the rear wall of the base 2, and can be used to close the storage compartment as depicted in FIGS. 7 and 8. In the embodiments shown in the accompanying drawings, this lid 3 also has front, rear and opposing side walls that generally align with the corresponding walls of the base 2 when closed.

The embodiment of the storage case 1 shown in the accompanying drawings is generally rectangular with rounded corners, substantially flat top and bottom walls, and peripheral walls that are substantially vertical. Alternatively, the case could be circular, elliptical, hexagonal, star-shaped or any other desired shape. Also, the vertical peripheral walls are optional. For example, the lid 3 and base 2 could define a rounded or clamshell structure. However, in general terms, the storage case can be viewed as having a front aspect, a rear aspect, and at least two opposing side aspects.

The entire storage case 1 can be fabricated as a single molded part that requires no assembly (i.e., no hinge or secondary components). The storage case 1 is complete directly from the molding process, which helps to reduce manufacturing costs. The hinge 5 can be a "living hinge"

that is common in many top-to-bottom closure cases and containers that are currently on the market.

Two side latches 10 and 12 extend upward from the side aspects of the base 2 as shown in FIGS. 1 and 2. These side latches 10, 12 include protrusions to removably engage complementary recesses 11, 13 in the interior side walls of the lid 3 when the lid 3 is closed. The user can release the latches 10, 12 by pressing inward on the side aspects of the base 2 adjacent to the side latches 10, 12. This deforms the side aspects and moves the side latches 10, 12 slightly inward to disengage them from the recesses 11, 13. The distance between the side latches 10, 12 exceeds the span of a small child's hand, but an adult should be able to readily actuate both side latches 10, 12 with one hand. Alternatively, the side latches could extend downward from the side aspects of the lid 3 to engage corresponding recesses or slots in the base 2. In either embodiment, the same pressure on the sides of the case could disengage the side latches from the recesses.

Figure 9:
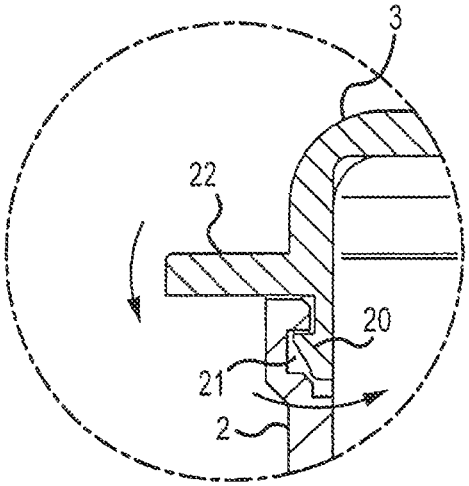
FIG. 9 is a detail cross-sectional view of the front latch mechanism.

The storage case 1 is also equipped with a front latch 20 comprising a bottom portion having a horizontal ledge surface as shown in the cross-sectional views provided in FIGS. 8 and 9. The front latch 20 extends downward from the front aspect of the lid 3 to removably engage a corresponding complementary feature (e.g., a recess 21, opening, lip, edge or protrusion) in the interior of the front wall of the base 2. The complimentary feature can be generally C-shaped and comprise a rearwardly facing recess that is partially defined by a downwardly facing horizontal abutment surface and the complementary feature can further comprise an upper horizontally extending surface. However, unlike the side latches 10 and 12, the front latch 20 is actuated by a horizontal tab 22 that extends forward from the front aspect of the lid 3 as shown in FIGS. 1, 3, 6, 8 and 9. In the embodiment shown in the accompanying drawings, the front latch 20 and horizontal tab 22 essentially form an L-shaped assembly that pivots or deflects with respect to the front wall of the lid 3 when downward force is applied to the horizontal tab 22, as illustrated by the arrows in FIG. 9. The user presses downward on this horizontal tab 22 to pivot or deflect the front latch 20 slightly inward and thereby disengage it from the recess 21. The horizontal tab 22 shown in the accompanying drawings is substantially planar, having planar upper and lower surfaces. The upper horizontally extending surface of the complimentary feature can abut the lower surface of the horizontal tab. It should be understood that this tab 22 could have other configurations or shapes, such as a post.

By pushing down on the horizontal tab 22, the adjacent section of the front wall of the lid 3 deflects in response to the angular moment arm exerted by the horizontal tab 22, thereby moving the front latch 20 away from the recess 21 in the front wall of the base 2. Thinning the wall at the corner (as shown in FIG. 9) can be used to reduce the force required to rotate the latch 20 out of the recess 21. Decreasing the thicknesses of the wall on both sides of the latch 20 can also reduce the force required to rotate or pivot the latch 20.

While still maintaining that downward force and simultaneously pressing inward on the side latches 10 and 12, a subsequent upward motion is required to lift the lid 3. This requirement of applying a downward moment on the horizontal tab 22 of the front latch mechanism while lifting upward on the lid 3 is counter-intuitive to most users, and particularly difficult for small children. It should be note that pressing upward on the horizontal tab 22 would be counter-productive and would only engage the front latch 20 more securely in the recess 21.

To open the storage case 1, the user must simultaneously press inward on both side latches 10, 12 and also press downward on the horizontal tab 22 of the front latch 20. An adult can easily open the storage case 1 using two hands. One hand is typically used to actuate the side latches 10 and 12, while the other hand is used to press downward on the horizontal tab 22 and exert a moment to deflect the front latch 20 inward. In contrast, a small child usually requires two hands to operate the side latches 10, 20 due to the distance between the side latches 10, 12. The distance between a child's thumb and middle finger, which is typically the greatest anatomical span between two fingers, is usually about 2.5 to 4 inches for a child of up to five years of age. This leaves no hands free to operate the front latch 20. A particularly enterprising child might try to actuate the front latch 20 with her teeth, nose, toe or some other body party. However, it would be very difficult for a child to exercise the required dexterity to press downward on the horizontal tab 22 while lifting the lid 3.

Closure is simply done by pushing down on the lid 3 to engage all of the snap-fit features, which offers a tactile response, both audible and by feel, so the user knows the storage case 1 has been completely closed.

Optionally, a lip or rail 30 can extend along the edges of the lid 3 or base 2 to cover the seam between base 2 and lid 3 when the lid 3 is closed, as illustrated in FIG. 7. This lip 30 serves to protect storage case from being pried open with a fingernail or bladed device.

Figure 10:
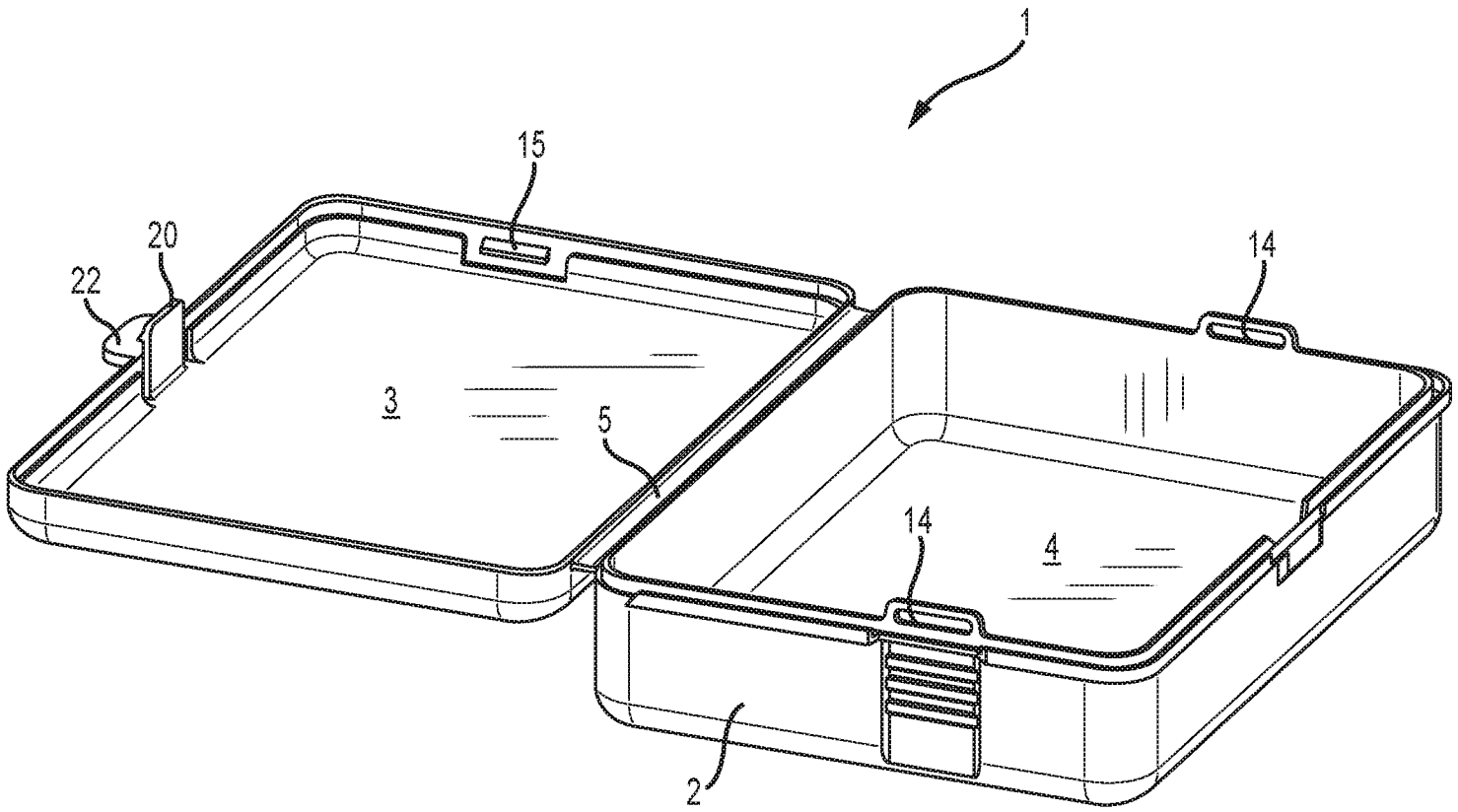
FIG. 10 is an axonometric view of another embodiment of the storage case 1 in which the side latches 10, 12 employ complementary sets of slots 14 and bumps 15.
Figure 11:
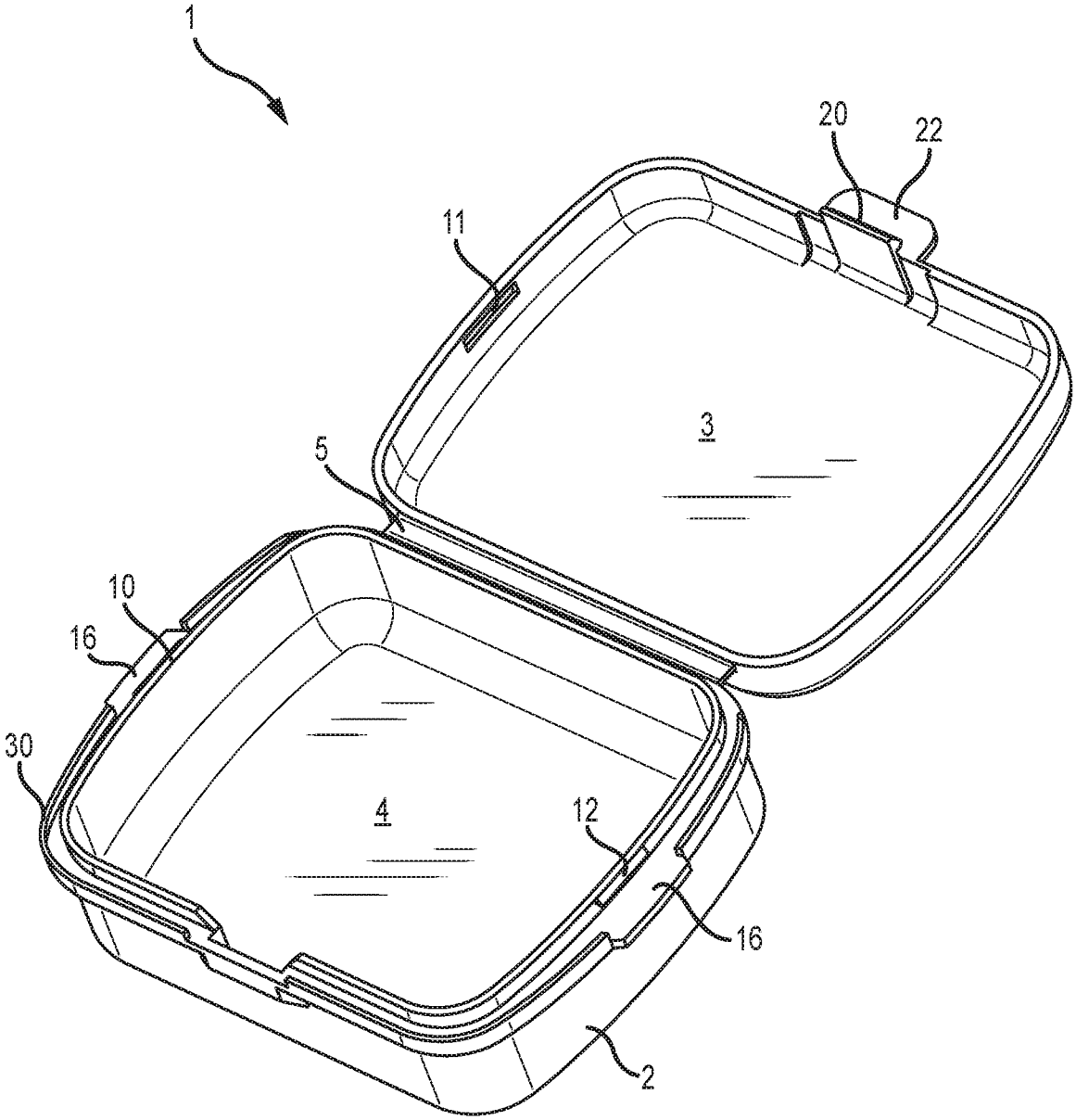
FIG. 11 is an axonometric view of another embodiment of the storage case in which the side latches 10, 12 have horizontal ridges 16 that must be pressed inward to release the lid 3.
Figure 12:
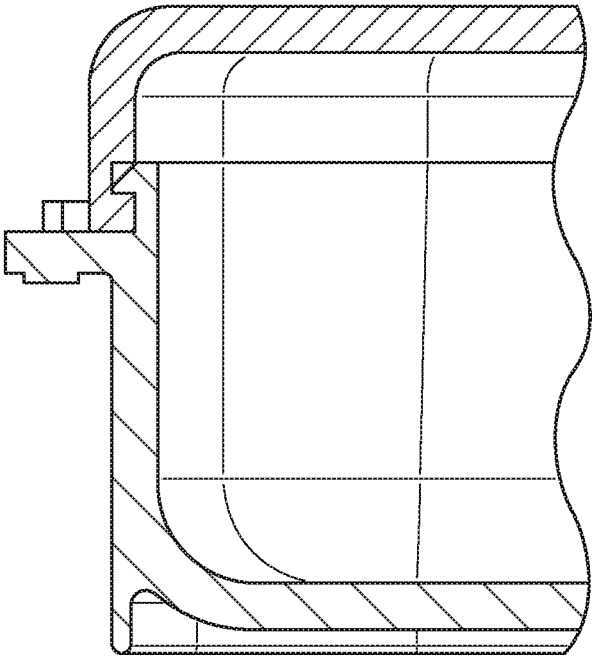
FIG. 12 is a detail cross-sectional view of a side latch mechanism corresponding to FIG. 11.

FIG. 10 illustrates an alternative embodiment of the opposing side latches. Here, the barbed side latches and recesses in the previous figures have been replaced with complementary sets of slots 14 and bumps 15. But, as before, the user must simultaneously press both opposing bumps 15 inward to release the side latches. For the purposes of this disclosure, it should be understood that such bumps 15 and slots 14, as well as other kinds of indents and detents, should be considered as falling within the scope of the terms "latches" and "recesses" as used herein. It should also be understood that other types of side latch mechanisms could be readily substituted. For example, FIG. 11 is an axonometric view of another embodiment of the storage case in which the side latches 10, 12 have horizontal ridges 16 that must be pressed inward to release the lid 3. FIG. 12 is a detail cross-sectional view of a side latch mechanism corresponding to FIG. 11. Here again, the thickness of the wall adjacent to the horizontal ridges 16 and side latches 10, 12 can be reduced to reduce the force required to disengage the side latches 10, 12 from the recesses 11, 13 in the lid 3.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A child-resistant storage case comprising:

a base;

a lid, said base and lid defining an interior storage space with peripheral walls; said base and lid each having a front aspect, a rear aspect and opposing side aspects; said front aspects and side aspects of said base and lid having interior surfaces;

a hinge connecting the rear aspects of the lid and base and enabling the lid to pivot between an open position permitting access to the interior storage space and a closed position preventing access to said interior storage space;

two side latches spaced apart from one another on the opposing side aspects releasably securing the lid to the base, said side latches releasing the lid from the base when pressed inward;

a front latch extending downward from the front aspect of the lid proximate to a thinned corner region of the lid that has a reduced thickness relative to adjacent portions of the lid, the front aspect of the lid on each lateral side of the front latch also having reduced thickness portions relative to adjacent portions of the lid such that force required to deflect said front latch is reduced relative to a lid without said reduced thickness portions, said front latch comprising a bottom portion having a horizontal ledge surface;

a complementary feature on the interior surface of the front aspect of the base to releasably engage the front latch and thereby secure the lid to the base; wherein said complementary feature is generally C-shaped and comprises a rearwardly facing recess that is partially defined by a downwardly facing horizontal abutment surface, said complimentary feature further comprising an upper horizontally extending surface;

a horizontal tab, said horizontal tab having planar upper and lower surfaces and extending forward from and beyond the front aspect of the lid adjacent to the front latch to form an L-shaped structure with the front latch, said L-shaped structure pivoting with respect to the lid upon said complimentary feature upper horizontally extending surface when the horizontal tab is pressed downward toward said base and away from the lid to pivot the front latch bottom portion inward with respect to the lid and with respect to the base to thereby release the front latch from the complementary feature on the interior surface of the front aspect of the base;

whereby a user must simultaneously press inward on the side latches, press downward on the horizontal tab toward the base and away from the lid to release the front latch, and lift upward on the lid to open the storage case;

wherein access to said upper surface of said tab is unobstructed and readily engageable by a user to downwardly rotatably deflect said horizontal tab; and wherein said C-shaped cavity of said complimentary feature receives said bottom portion of said front latch therein with said horizontal ledge surface of said front latch bottom portion engaged by said horizontal abutment surface of said complimentary feature and maintains said lid is in said closed position until said front latch bottom portion is rotatably inwardly deflected to release said latch bottom portion from said C-shaped cavity.

2. The child-resistant storage case of claim 1 wherein at least one of the side latches comprise one of a protrusion and complementary recess on the interior surface of one of the side aspects of the base, with the other of the protrusion and complementary recess on the interior surface of an adjacent one of the side aspects of the lid.

3. The child-resistant storage case of claim 1 wherein the user must press downward on the horizontal tab toward the base outwardly of the front aspect of the lid to release the front latch.

4. The child-resistant storage case of claim 1 wherein release of the front latch can be accomplished by downward pressure alone on the horizontal tab toward the base.

* * * * *